US006367915B1

(12) United States Patent
Gooray et al.

(10) Patent No.: US 6,367,915 B1
(45) Date of Patent: Apr. 9, 2002

(54) MICROMACHINED FLUID EJECTOR SYSTEMS AND METHODS

(75) Inventors: Arthur M. Gooray; George J. Roller, both of Penfield, NY (US); Joseph M. Crowley, Morgan Hill, CA (US); Paul C. Galambos; Frank J. Peter, both of Albuquerque, NM (US); Kevin R. Zavadil, Bernilillo, NM (US); Richard C. Givler, Albuquerque, NM (US)

(73) Assignee: Xerox Corporation, Stanford, CT (US)

( * ) Notice: Subject to any disclaimer, the term of this patent is extended or adjusted under 35 U.S.C. 154(b) by 0 days.

(21) Appl. No.: 09/722,331

(22) Filed: Nov. 28, 2000

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–338

(56) References Cited

U.S. PATENT DOCUMENTS 4,520,375 A 5/1985 Kroll
5,501,893 A 3/1996 Laermer et al.
5,668,579 A 9/1997 Fujii et al.
5,754,205 A 5/1998 Miyata et al.
5,783,340 A 7/1998 Farino et al.
5,798,283 A 8/1998 Montague et al.
5,804,084 A 9/1998 Nasby et al.
5,821,951 A 10/1998 Fujii et al.
5,828,394 A 10/1998 Khuri-Yakub et al.
5,919,548 A 7/1999 Barron et al.
5,963,788 A 10/1999 Barron et al.
6,082,208 A 7/2000 Rodgers et al.
6,127,198 A 10/2000 Coleman et al.

*Primary Examiner*—Raquel Yvette Gordon
(74) *Attorney, Agent, or Firm*—Oliff & Berridge, PLC

(57) ABSTRACT

An electrostatic microelectromechanical system (MEMS) based fluid ejector comprises a movable piston structure and a stationary faceplate. A fluid chamber is defined between the piston structure and a substrate. The piston structure 110 may be resiliently mounted on the substrate by one or more spring elements. A fluid to be ejected is supplied in the fluid chamber from a fluid reservoir through a fluid refill hole formed in the substrate. The faceplate includes a nozzle hole through which a fluid jet or drop is ejected. In various exemplary embodiments, the piston structure moves towards the faceplate by electrostatic attraction between the piston structure and the faceplate. As a result of the movement of the piston structure, a portion of the fluid between the piston structure and the faceplate is forced out of the nozzle hole, forming a jet or drop of the fluid.

24 Claims, 3 Drawing Sheets

FIG. 1
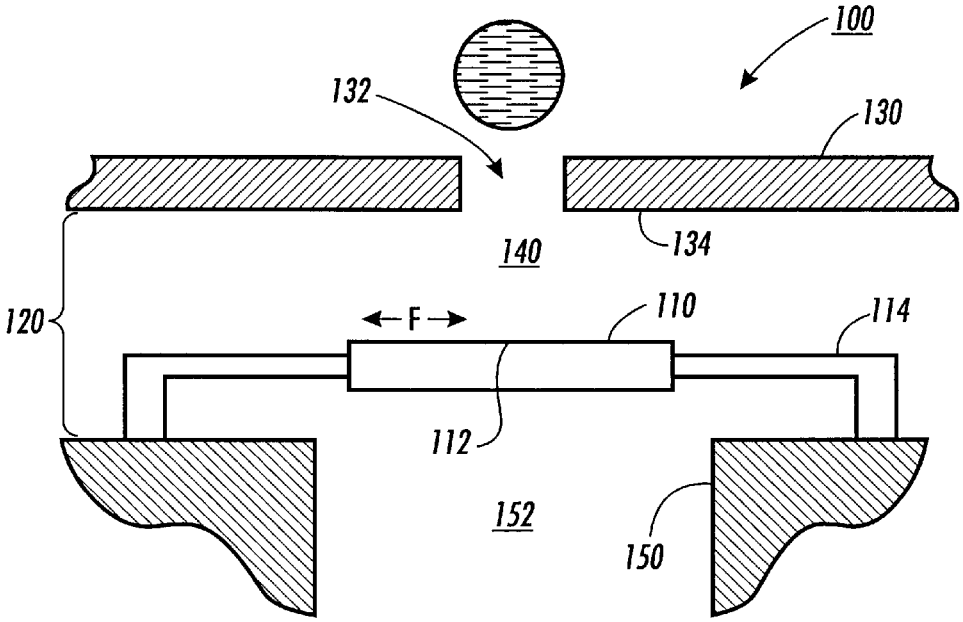
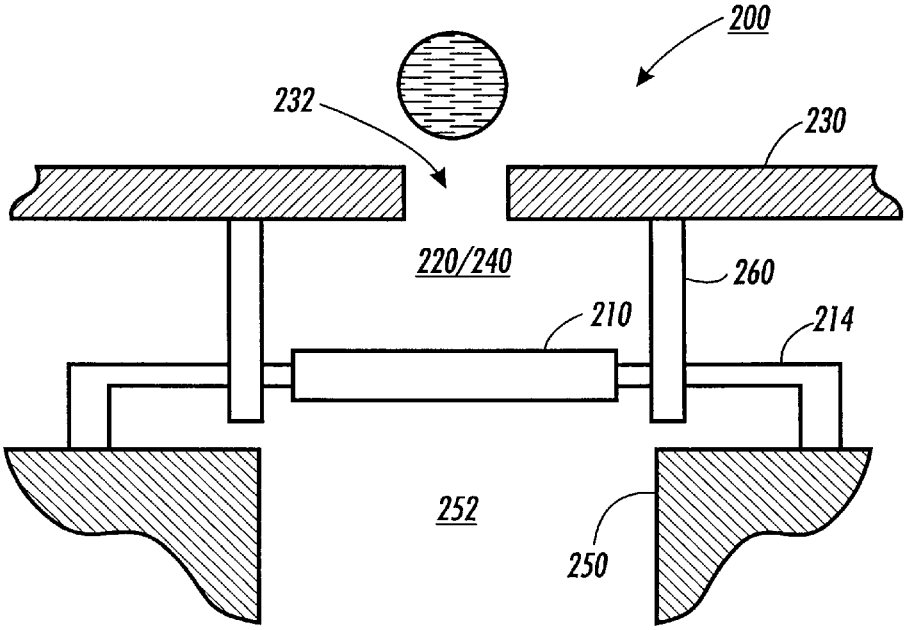
FIG. 2

FIG. 3
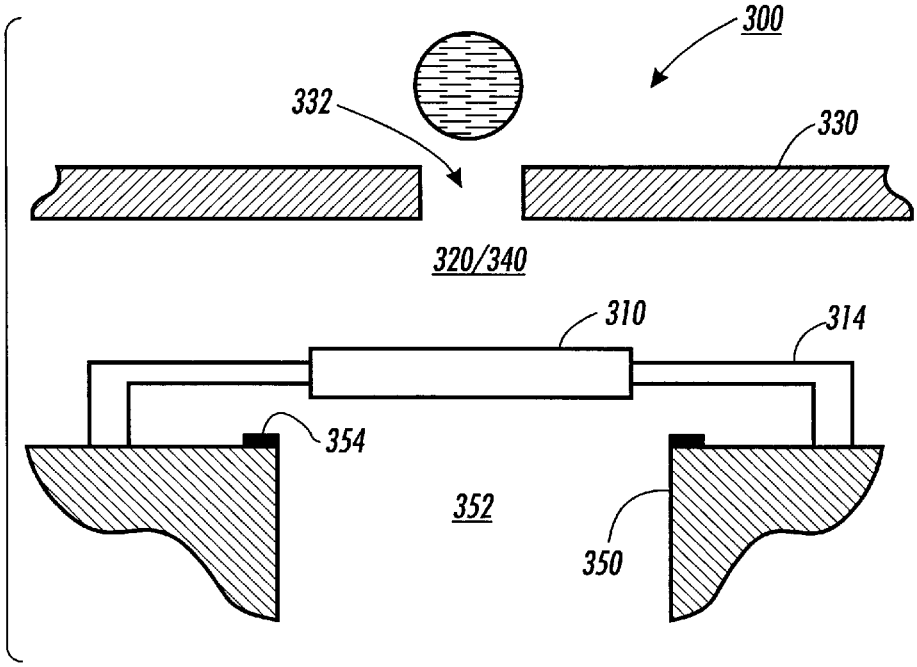
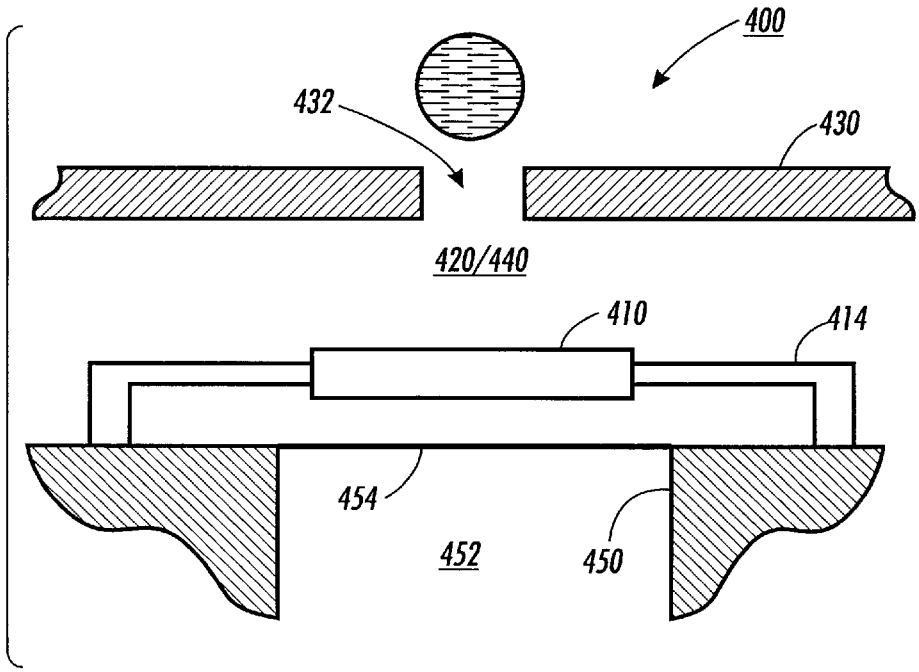
FIG. 4

MICROMACHINED FLUID EJECTOR SYSTEMS AND METHODS

BACKGROUND OF THE INVENTION

1. Field of Invention

This present invention relates to micromachined or microelectromechanical system (MEMS) based fluid ejectors.

2. Description of Related Art

Fluid ejectors have been developed for ink jet recording or printing. Ink jet printing systems offer numerous benefits, including extremely quiet operation when printing, high speed printing, a high degree of freedom in ink selection, and the ability to use low-cost plain paper. The so-called "drop-on-demand" drive method, where ink is output only when required for printing, is now the conventional approach. The drop-on-demand drive method makes it unnecessary to recover ink not needed for printing.

Fluid ejectors for ink jet printing include one or more nozzles which allow the formation and control of small ink droplets to permit high resolution, resulting in the ability to print sharper characters with improved tonal resolution. In particular, drop-on-demand ink jet print heads are generally used for high resolution printers.

Drop-on-demand technology generally uses some type of pulse generator to form and eject drops. For example, in one type of print head, a chamber having an ink nozzle may be fitted with a piezoelectric wall that is deformed when a voltage is applied. As a result of the deformation, the fluid is forced out of the nozzle orifice as a drop. The drop then impinges directly on an associated printing surface. Use of such a piezoelectric device as a driver is described in JP B-1990-51734.

Another type of print head uses bubbles formed by heat pulses to force fluid out of the nozzle. The drops are separated from the ink supply when the bubbles form. Use of pressure generated by heating the ink to generate bubbles is described in JP B-1986-59911.

Yet another type of drop-on-demand print head incorporates an electrostatic actuator. This type of print head utilizes electrostatic force to eject the ink. Examples of such electrostatic print heads are disclosed in U.S. Pat. No. 4,520,375 to Kroll and Japanese Laid-Open Patent Publication No. 289351/90. The inkjet head disclosed in the 375 patent uses an electrostatic actuator comprising a diaphragm that constitutes a part of an ink ejection chamber and a base plate disposed outside of the ink ejection chamber opposite to the diaphragm. The inkjet head ejects ink droplets through a nozzle communicating with the ink ejection chamber, by applying a time varying voltage between the diaphragm and the base plate. The diaphragm and the base plate thus act as a capacitor, which causes the diaphragm to be set into mechanical motion and the fluid to exit responsive to the diaphragm's motion. On the other hand, the ink jet head discussed in the Japan 351 distorts its diaphragm by applying a voltage to an electrostatic actuator fixed on the diaphragm. This result in suction of additional ink into an ink ejection chamber. Once the voltage is removed, the diaphragm is restored to its non-distorted condition, ejecting ink from the overfilled ink ejection chamber.

Fluid drop ejectors may be used not only for printing, but also for depositing photoresist and other liquids in the semiconductor and flat panel display industries, for delivering drug and biological samples, for delivering multiple chemicals for chemical reactions, for handling DNA sequences, for delivering drugs and biological materials for interaction studies and assaying, and for depositing thin and narrow layers of plastics for usable as permanent and/or removable gaskets in micro-machines.

SUMMARY OF THE INVENTION

This invention provides fluid ejection systems and methods having improved performance characteristics.

This invention separately provides fluid ejection systems and methods having improved response to actuation signals and/or improved control.

This invention separately provides fluid ejection systems and methods having improved efficiency.

This invention separately provides fluid ejection systems and methods having improved electrostatic fields.

This invention separately provides fluid ejection systems and methods having improved fluid refill.

This invention separately provides fluid ejection systems and methods having increased drop generation rate.

This invention separately provides fluid ejection systems and methods having reduced viscous fluid forces that oppose refill of the fluid after ejection.

This invention separately provides fluid ejection systems and methods where the viscous fluid forces opposing movement of the actuator used to eject the fluid prevent the actuator from contacting other structures of the ejector.

This invention separately provides fluid ejection systems and methods having fluid ejectors with improved structural features.

This invention separately provides fluid ejection systems and methods having fluid ejectors with simplified design, construction and fabrication.

In various embodiments, the fluid ejectors according to this invention include an unsealed movable piston structure usable to eject fluid drops. In other various embodiments, the fluid ejectors according to this invention provide unimpeded fluid flow adjacent the piston structure in a direction transverse to the direction of movement of the piston structure. In still other various embodiments, the fluid ejectors according to this invention include a counter-electrode.

According to various exemplary embodiments of the systems and methods of this invention, a micromachined fluid ejector includes a movable piston structure arranged to eject fluid drops. The piston structure is resiliently movably supported within a fluid chamber, such that movement of the piston structure ejects fluid. In various embodiments, the fluid chamber is defined between a substrate and a faceplate including a nozzle hole such that transverse fluid flow is substantially unrestricted near the piston structure. In other various embodiments, the fluid ejectors according to this invention include an ink feed hole formed through the substrate.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the systems and methods of this invention are described in detail below, with reference to the attached drawing figures, in which:

FIG. 1 is a cross-sectional view of a first exemplary embodiment of a fluid ejector according to this invention;

FIG. 2 is a cross-sectional view of an exemplary embodiment of a fluid ejector according to a related invention;

FIG. 3 is a cross-sectional view of a second exemplary embodiment of a fluid ejector according to this invention;

FIG. 4 is a cross-sectional view of a third exemplary embodiment of a fluid ejector according to this invention.

DETAILED DESCRIPTION OF PREFERRED EMBODIMENTS

Figure 5:
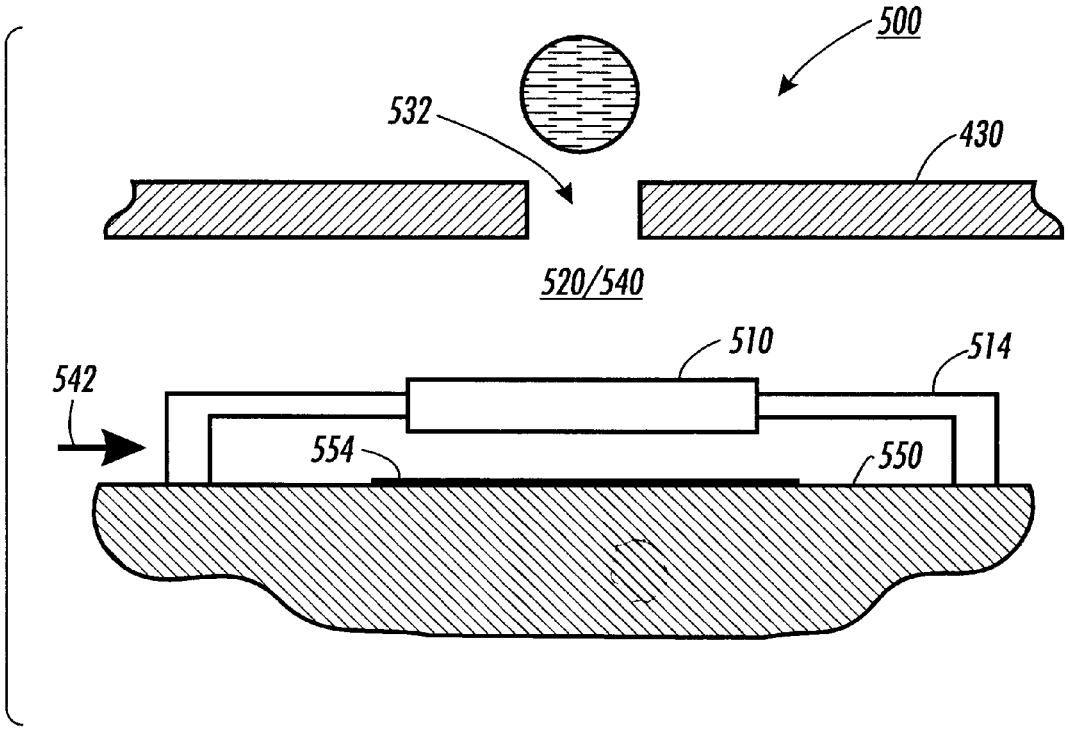
FIG. 5 is a cross-sectional view of a fourth exemplary embodiment of a fluid ejector according to this invention.

The fluid ejectors according to this invention include electrostatically or magnetically driven piston structures whose movement ejects a relatively small amount of fluid, commonly referred to as a drop or droplet. The fluid ejectors according to this invention may be fabricated using the SUMMiT processes or other suitable micromachining processes. The SUMMiT processes are covered by various U.S. patents belonging to Sandia National Labs, including U.S. Pat. Nos. 5,783,340; 5,798,283; 5,804,084; 5,919,548; 5,963,788; and 6,053,208, each of which is incorporated herein by reference in its entirety. The SUMMiT processes are primarily covered by the '084 and '208 patents. In particular, the methods discussed in copending U.S. patent application Ser. No. 09/723,243, filed herewith and incorporated herein by reference in its entirety, may be used.

Various design configurations of the micromachined fluid ejectors of the present invention are discussed in copending U.S. patent applications Ser. Nos. 09/718,420, 09/718,495 and 09/718,476, each of which is filed herewith and incorporated herein by reference in its entirety. As with the systems and methods of this invention, these design configurations generally comprise a piston structure that is movably mounted within a fluid chamber. Movement of the piston structure towards a faceplate causes a fluid drop to be ejected through a nozzle hole.

Such movement can be effectuated through any suitable drive system. However, electrostatic and magnetic forces are particularly applicable. For example, electrostatic or magnetic attraction of the piston structure to the faceplate may be used to drive the piston structure. Alternatively, electrostatic or magnetic attraction of the piston structure away from the faceplate may be used. In such a case, the piston structure is resiliently mounted so that a restoring force is generated to move the piston structure to its undisplaced position to eject a fluid drop. Another exemplary drive system suitable for this invention is an electrostatic comb drive. The fluid ejectors of the present invention may be actuated according to the methods described in copending U.S. patent application Ser. No. 09/718,480, which is filed herewith and incorporated herein by reference in its entirety.

As described above, movement of the piston structure causes a portion of the fluid between the piston and the faceplate to be forced out of the nozzle hole in the faceplate, forming a drop or jet of fluid. As the piston structure approaches the faceplate, viscous forces that are generated by the flow of the fluid along a working surface of the piston structure toward and away from the nozzle hole cause a force that resists the movement of the piston structure. Such resistance force tends to slow the piston motion, and prevents the piston from contacting the faceplate.

In various embodiments of this invention, the fluid chamber is defined between the substrate and the faceplate without a "cylinder" structure. This avoids potential drawbacks and design considerations incurred by a cylinder structure. For example, design and fabrication are simplified, since physical clearances between the piston structure and the cylinder structure are no longer a concern. Also, the possibility of induced electrostatic field effects between the piston structure and the cylinder structure are eliminated. Since fluid flow in a direction transverse to the piston structure movement is not impeded by any structure near the piston structure, fluid refill is improved.

In various embodiments of this invention, a counter-electrode is associated with the substrate. The counter-electrode is used to move the piston structure in a direction away from the faceplate. Thus, the counter-electrode may be used to help return the piston structure to an at rest position when electrostatic attraction of the piston structure to the faceplate is used to drive the piston structure.

In various exemplary embodiments of this invention, fluid ejector performance and fluid ejector refill are improved by forming a fluid refill hole through the substrate. In particular, fluid refill hole may be formed substantially aligned with the piston structure. In various exemplary embodiments, viscous fluid forces opposing the movement of the piston structure are reduced. In various exemplary embodiments, less time is required for fluid refill.

While this invention is described relative to a "roof shooter" configuration, it should be understood that the systems and methods of this invention may be used with other configurations, such as, for example, an "edge shooter" or a "back shooter" configuration, in which the piston actuates toward the substrate to eject a drop through a nozzle hole formed in the substrate. Also, while single fluid ejectors are used to describe this invention, it should be understood that the systems and methods of this invention may be used in an array or other arrangement of multiple fluid ejectors, for example, the print head assembly described in the incorporated application Ser. No. 09/718,480.

FIG. 1 shows a first exemplary embodiment of an electrostatic microelectromechanical system (MEMS)-based fluid ejector 100 according to this invention. The fluid ejector 100 comprises a movable piston structure 110 and a stationary faceplate 130. A fluid chamber 120 is defined between the piston structure 110 and a substrate 150. As shown in FIG. 1, the piston structure 110 may be resiliently mounted on the substrate 150 by one or more spring elements 114. A fluid 140 to be ejected is supplied to the fluid chamber 120 from a fluid reservoir (not shown) through a fluid refill hole 152 formed in the substrate 150. The faceplate 130 includes a nozzle hole 132 through which a fluid jet or drop is ejected.

In this exemplary embodiment, the piston structure 110 moves towards the faceplate 130 due to electrostatic attraction between the piston structure 110 and the faceplate 130. As a result of the movement of the piston structure 110, a portion of the fluid 140 between the piston structure 110 and the faceplate 130 is forced out of the nozzle hole 132, forming a jet or drop of the fluid.

As the piston structure 110 approaches the faceplate 130, viscous forces opposing the flow F of the fluid 140 along a working surface 112 of the piston structure 110 and an inner surface 134 of the faceplate 130 result in a squeeze-film force that resists the movement of the piston structure 110. The squeeze-film force is discussed further in the incorporated application Ser. No. 09/718,420. The squeeze-film force effectively limits the flow F of the fluid 140 to a certain value, depending on design dimensions of the fluid ejector 100 and the fluid properties of the fluid 140, such as viscosity.

FIG. 2 shows an exemplary embodiment of an electrostatic microelectromechanical system (MEMS) based fluid ejector 200 related to this invention. According to this exemplary embodiment, the movable piston structure 210 of the fluid ejector 200 is movable within a cylinder structure 260 that extends from the stationary faceplate 230 around the nozzle hole 232. The fluid chamber 220 is defined between the piston structure 210, the faceplate 230 and the cylinder structure 260. Again, the piston structure 210 may be resiliently mounted on the substrate 250 by one or more spring elements 214. The fluid 240 to be ejected is supplied in the fluid chamber 220 from a fluid reservoir (not shown) through a fluid refill hole 252 formed in the substrate 250.

The cylinder structure 260 is intended to minimize "leakage" of the fluid 240 around the piston structure 210 during fluid ejection to improve fluid ejection performance of the fluid ejector 200. In such a design, the physical clearances between the piston structure 210 and the cylinder structure 260 should be carefully determined and fabricated to reduce leakage while reducing interaction with particulates contained within the fluid 240, such as, for example, pigment particles. On the other hand, potential induced electrostatic field effects between the cylinder structure 260 and the piston structure 210 arise. Thus, tradeoffs are required between reducing leakage and reducing the intensity of any induced electrostatic fields between the cylinder structure 260 and the piston structure 210. Additionally, the cylinder structure 260 may hinder flow of the fluid 240 into the fluid chamber 220 for fluid refill. Since the first exemplary embodiment of this invention shown in FIG. 1 does not include a cylinder structure, these design constraints and potential drawbacks are not incurred.

FIG. 3 shows a second exemplary embodiment of an electrostatic microelectromechanical system (MEMS)-based fluid ejector 300 according to this invention. The fluid ejector 300 comprises a movable piston structure 310 and a stationary faceplate 330. A fluid chamber 320 is defined between the piston structure 310 and a substrate 350. As shown in FIG. 3, the piston structure 310 may be resiliently mounted on the substrate 350 by one or more spring elements 314. A fluid 340 to be ejected is supplied to the fluid chamber 320 from a fluid reservoir (not shown) through a fluid refill hole 352 formed in the substrate 350. The faceplate 330 includes a nozzle hole 332 through which a fluid jet or drop is ejected.

The fluid refill hole 352 formed in the substrate 350 substantially reduces viscous fluid forces that oppose movement of the piston structure 310 toward the faceplate 330, by allowing relatively free flow of the fluid 340 behind the piston structure 310. This results in a greater net force being applied to the piston structure 310 for a given applied electrostatic field. Also, the fluid refill hole 352 increases the performance and efficiency of the fluid ejector 300 by reducing the time required for refilling, since the fluid refill path is relatively short. The fluid refill hole 352 may be formed using the method described in the incorporated (Attorney Docket No. 106460) application.

The fluid ejector 300 shown in FIG. 3 also includes an annular counterelectrode 354 associated with the substrate 350. The counter-electrode 354 is situated around the fluid refill hole 352 to reduce any restrictions on the flow of the fluid 340 through the fluid refill hole 352. The counter-electrode 354 may be used to assist the spring elements 314 in returning the piston structure 310 to its at-rest position. Thus, the counter-electrode 354 may increase the performance and efficiency of the fluid ejector 300 by reducing the time required for "resetting" the piston structure 310 so the piston structure 310 is ready to eject another drop of the fluid 340.

FIG. 4 shows a third exemplary embodiment of an electrostatic microelectromechanical system (MEMS)-based fluid ejector 400 according to this invention. The fluid ejector 400 comprises a movable piston structure 410 and a stationary faceplate 430. A fluid chamber 420 is defined between the piston structure 410 and a substrate 450. As shown in FIG. 4, the piston structure 410 may be resiliently mounted on the substrate 450 by one or more spring elements 414. A fluid 440 to be ejected is supplied to the fluid chamber 420 from a fluid reservoir (not shown) through a fluid refill hole 452 formed in the substrate 450. The faceplate 430 includes a nozzle hole 432 through which a fluid jet or drop is ejected.

As with the fluid ejector 300 shown in FIG. 3, the fluid ejector 400 includes a counter-electrode 454 associated with the substrate 450. In this embodiment, however, the counter-electrode 454 is a filtering screen situated in or over the fluid refill hole 452. As such, the counter-electrode 454 may also be used to prevent, or at least restrict, unwanted particles from entering the fluid chamber 420 of the fluid ejector 400 and being ejected with the fluid 440.

FIG. 5 shows a fourth exemplary embodiment of an electrostatic microelectromechanical system (MEMS)-based fluid ejector 500 according to this invention. The fluid ejector 500 comprises a movable piston structure 510 and a stationary faceplate 530. The faceplate 530 includes a nozzle hole 432 through which a fluid jet or drop is ejected. A fluid chamber 520 is defined between the piston structure 510 and a substrate 550. As shown, a counter-electrode 554 is formed on the substrate 550. Also as shown, the piston structure 510 is resiliently mounted on the substrate 550 by one or more spring elements 514. A fluid 540 to be ejected is supplied to the fluid chamber 520 from a fluid reservoir (not shown) through a lateral supply path 542.

Thus, the fluid ejector 500 differs from the previous exemplary embodiments by not including a fluid refill hole formed through the substrate 550. In this embodiment, as the piston structure 510 is moved towards the faceplate 530, the actuation force has to overcome an additional force generated by the viscosity of the fluid 540 filling the space created between the piston structure 510 and the counter-electrode 554 by movement of the piston structure 510. The magnitude of this force is related to the dimensions of the piston structure 510 and the distance between the piston structure 510 and the counter-electrode 554.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A microelectromechanical system-based fluid ejector, comprising:

a movable piston structure having a working surface with an outer edge, the piston structure being movable in a direction substantially perpendicular to the working surface; and a fluid chamber defined within the fluid ejector such that a fluid in the fluid chamber flows freely in a direction transverse to the working surface in a region adjacent the outer edge of the working surface.

2. The fluid ejector of claim 1, further comprising:

a faceplate having a nozzle hole through which a drop of the fluid in the fluid chamber is to be ejected;

a substrate disposed opposite the faceplate, the piston structure being situated between the substrate and the faceplate; and a fluid refill hole formed through the substrate to supply the fluid to the fluid chamber.

3. The fluid ejector of claim 2, wherein the piston structure is situated between the substrate and the faceplate aligned with the fluid refill hole.

4. The fluid ejector of claim 1, further comprising:

a faceplate having a nozzle hole through which a drop of the fluid in the fluid chamber is to be ejected;

a substrate disposed opposite the faceplate, the piston structure being situated between the substrate and the faceplate; and a counter-electrode associated with the substrate.

5. The fluid ejector of claim 4, wherein the piston structure is situated between the substrate and the faceplate aligned with the counter-electrode.

6. The fluid ejector of claim 4, further comprising a fluid refill hole formed through the substrate to supply the fluid to the fluid chamber, wherein the counter-electrode is disposed substantially around a periphery of the fluid refill hole.

7. The fluid ejector of claim 6, wherein the piston structure is situated between the substrate and the faceplate aligned with the fluid refill hole.

8. The fluid ejector of claim 6, wherein the counter-electrode comprises an annular counter-electrode.

9. The fluid ejector of claim 4, further comprising a fluid refill hole formed through the substrate to supply the fluid to the fluid chamber, wherein the counter-electrode comprises a filter and is situated over the fluid refill hole.

10. The fluid ejector of claim 4, further comprising a fluid refill hole formed through the substrate to supply the fluid to the fluid chamber, wherein the counter-electrode comprises a filter and is situated within the fluid refill hole.

11. A microelectromechanical system-based fluid ejector, comprising:

a fluid chamber defined within the fluid ejector; and a movable piston structure disposed within the fluid chamber without a corresponding cylinder structure, such that a fluid in the fluid chamber flows freely in a direction transverse to a working surface of the piston structure in a region adjacent an outer edge of the working surface.

12. The fluid ejector of claim 11, further comprising:

a faceplate having a nozzle hole through which a drop of the fluid in the fluid chamber is to be ejected;

a substrate disposed opposite the faceplate, the piston structure being situated between the substrate and the faceplate; and a fluid refill hole formed through the substrate to supply the fluid to the fluid chamber.

13. The fluid ejector of claim 12, wherein the piston structure is situated between the substrate and the faceplate aligned with the fluid refill hole.

14. The fluid ejector of claim 11, further comprising:

a faceplate having a nozzle hole through which a drop of the fluid in the fluid chamber is to be ejected;

a substrate disposed opposite the faceplate, the piston structure being situated between the substrate and the faceplate; and a counter-electrode associated with the substrate.

15. The fluid ejector of claim 14, wherein the piston structure is situated between the substrate and the faceplate aligned with the counter-electrode.

16. The fluid ejector of claim 14, further comprising a fluid refill hole formed through the substrate to supply the fluid to the fluid chamber, wherein the counter-electrode is disposed substantially around a periphery of the fluid refill hole.

17. The fluid ejector of claim 16, wherein the piston structure is situated between the substrate and the faceplate aligned with the fluid refill hole.

18. The fluid ejector of claim 16, wherein the counter-electrode comprises an annular counter-electrode.

19. The fluid ejector of claim 14, further comprising a fluid refill hole formed through the substrate to supply the fluid to the fluid chamber, wherein the counter-electrode comprises a filter and is situated over the fluid refill hole.

20. The fluid ejector of claim 14, further comprising a fluid refill hole formed through the substrate to supply the fluid to the fluid chamber, wherein the counter-electrode comprises a filter and is situated within the fluid refill hole.

21. A method of ejecting a fluid using a microelectromechanical system-based fluid ejector having a movable piston structure disposed in a fluid chamber between a substrate and a faceplate having a nozzle hole, comprising:

moving a movable piston structure within a fluid chamber such that a fluid in the fluid chamber flows in a direction transverse to a working surface of the piston structure; and ejecting a drop of the fluid through a nozzle hole in a faceplate substantially by viscous fluid flow forces between the working surface of the piston structure and a stationary structure of the fluid ejector associated with moving the piston structure.

22. The method of claim 21, further comprising refilling the fluid in the fluid chamber through a fluid refill hole formed through the substrate.

23. The method of claim 22, further comprising actively moving the movable piston structure towards an at-rest position.

24. The method of claim 22, further comprising filtering the fluid prior to refilling the fluid in the fluid chamber.

* * * * *

UNITED STATES PATENT AND TRADEMARK OFFICE

CERTIFICATE OF CORRECTION

PATENT NO. : 6,367,915 B1
DATED : April 9, 2002
INVENTOR(S) : Gooray et al.

It is certified that error appears in the above-identified patent and that said Letters Patent is hereby corrected as shown below:

Column 1,
After the Title, please insert the following paragraph:

-- GOVERNMENT RIGHTS
This invention was made with Government support under Contract No. DE-AC04-94AL85000 awarded by the U.S. Department of Energy. The Government has certain rights in the invention. --

Signed and Sealed this

Third Day of December, 2002

JAMES E. ROGAN
*Director of the United States Patent and Trademark Office*